US010407789B2

(12) United States Patent
Ganapathy et al.

(10) Patent No.: US 10,407,789 B2
(45) Date of Patent: Sep. 10, 2019

(54) UNIFORM CRACK-FREE ALUMINUM DEPOSITION BY TWO STEP ALUMINUM ELECTROPLATING PROCESS

(71) Applicant: Applied Materials, Inc., Santa Clara, CA (US)

(72) Inventors: Balaji Ganapathy, Navi Mumbai (IN); Ankur Kadam, Mumbai (IN); Prerna S. Goradia, Mumbai (IN); Laksheswar Kalita, Mumbai (IN); Tapash Chakraborty, Maharashtra (IN); Vijay Bhan Sharma, Mumbai (IN)

(73) Assignee: APPLIED MATERIALS, INC., Santa Clara, CA (US)

( * ) Notice: Subject to any disclaimer, the term of this patent is extended or adjusted under 35 U.S.C. 154(b) by 69 days.

(21) Appl. No.: 15/835,067

(22) Filed: Dec. 7, 2017

(65) Prior Publication Data

US 2018/0163317 A1 Jun. 14, 2018

Related U.S. Application Data

(60) Provisional application No. 62/465,206, filed on Mar. 1, 2017.

(30) Foreign Application Priority Data

Dec. 8, 2016 (IN) ..... 201641041929

(51) Int. Cl.

| | |
|---|---|
| ***C25D 3/44*** | (2006.01) |
| ***C25D 5/44*** | (2006.01) |
| ***C25D 5/48*** | (2006.01) |
| ***C25D 5/18*** | (2006.01) |
| ***C25D 7/00*** | (2006.01) |
| ***C25D 5/50*** | (2006.01) |

(Continued)

(52) U.S. Cl.

CPC ..... *C25D 5/44* (2013.01); *C25D 3/44* (2013.01); *C25D 5/18* (2013.01); *C25D 5/48* (2013.01); *C25D 5/50* (2013.01); *C25D 7/00* (2013.01); *C25D 9/08* (2013.01); *C25D 11/04* (2013.01); *C25D 5/022* (2013.01)

(58) Field of Classification Search

CPC ..... C25D 3/44; C25D 5/18
USPC ..... 205/104, 237
See application file for complete search history.

(56) References Cited

U.S. PATENT DOCUMENTS

| | | | |
|---|---|---|---|
| 4,071,526 | A | 1/1978 | Dotzer et al. |
| 5,158,663 | A | 10/1992 | Yahalom |

(Continued)

*Primary Examiner* — Brian W Cohen
(74) *Attorney, Agent, or Firm* — Patterson + Sheridan LLP

(57) ABSTRACT

In one implementation, a method of depositing a material on a substrate is provided. The method comprises positioning an aluminum-containing substrate in an electroplating solution, the electroplating solution comprising a non-aqueous solvent and a deposition precursor. The method further comprises depositing a coating on the aluminum-containing substrate, the coating comprising aluminum or aluminum oxide. Depositing the coating comprises applying a first current for a first time-period to nucleate a surface of the aluminum-containing substrate and applying a second current for a second time-period, wherein the first current is greater than the second current and the first time-period is less than the second time-period to form the coating on the nucleated surface of the aluminum-containing substrate.

14 Claims, 3 Drawing Sheets

(51) Int. Cl.

| | |
|---|---|
| ***C25D 9/08*** | (2006.01) |
| ***C25D 11/04*** | (2006.01) |
| *C25D 5/02* | (2006.01) |

(56) References Cited

U.S. PATENT DOCUMENTS

| | | | | |
|---|---|---|---|---|
| 2004/0137147 | A1 | 7/2004 | O'Donnell et al. | |
| 2008/0017516 | A1 | 1/2008 | Han et al. | |
| 2010/0112378 | A1 | 5/2010 | Deininger et al. | |
| 2011/0083967 | A1* | 4/2011 | Ruan | C25D 3/66 205/238 |
| 2012/0138472 | A1 | 6/2012 | Han et al. | |
| 2012/0144640 | A1 | 6/2012 | Shih et al. | |
| 2013/0168258 | A1 | 7/2013 | Nakano et al. | |
| 2014/0374263 | A1* | 12/2014 | Cai | C25D 3/665 205/50 |
| 2015/0275375 | A1 | 10/2015 | Kim et al. | |
| 2017/0260639 | A1 | 9/2017 | Pareek et al. | |
| 2018/0066375 | A1* | 3/2018 | Morgan | B32B 15/01 |

* cited by examiner

UNIFORM CRACK-FREE ALUMINUM DEPOSITION BY TWO STEP ALUMINUM ELECTROPLATING PROCESS

CROSS-REFERENCE TO RELATED APPLICATIONS

This application claims benefit of U.S. Provisional Patent Application Ser. No. 62/465,206, filed Mar. 1, 2017, and India Provisional Application No. 201641041929, filed Dec. 8, 2016, both of which are incorporated herein by reference in their entirety.

BACKGROUND

Field

Implementations of the present disclosure generally relate to forming protective layers on mechanical components, and more particularly, to electrodeposition of coatings, such as aluminum or aluminum oxide, on semiconductor processing equipment.

Description of the Related Art

Conventionally, semiconductor processing equipment surfaces include certain coatings thereon to provide a degree of protection from the corrosive processing environment or to promote surface protection of the equipment. Several conventional methods utilized to coat the protective layer include physical vapor deposition (PVD), chemical vapor deposition (CVD), plasma spraying, aerosol deposition, and the like. However, these conventional methods are unable to satisfactorily coat semiconductor equipment, especially in areas having small holes or plenums, such as showerheads. Some other techniques such as anodization of the substrate and polyethylene oxide (PEO) coatings can form a barrier layer inside the holes; however, these barrier layers inherently include porosity. The porosity of these layers can trap halides therein, and release the halides during processing thus causing unwanted contamination. Additional problems include cracking of the deposited protective coatings.

Therefore, there is a need for improved deposition methods for protective coatings.

SUMMARY

Implementations of the present disclosure generally relate to forming protective layers on mechanical components, and more particularly, to electrodeposition of coatings, such as aluminum or aluminum oxide, on semiconductor processing equipment. In one implementation, a method of depositing a material on a substrate is provided. The method comprises positioning an aluminum-containing substrate in an electroplating solution, the electroplating solution comprising a non-aqueous solvent and a deposition precursor. The method further comprises depositing a coating on the aluminum-containing substrate, the coating comprising aluminum or aluminum oxide. Depositing the coating comprises applying a first current for a first time-period to nucleate a surface of the aluminum-containing substrate and applying a second current for a second time-period to form the coating on the nucleated surface of the aluminum-containing substrate. The first current is greater than the second current and the first time-period is less than the second time-period.

In another implementation, a method of depositing a material on a substrate is provided. The method comprises positioning an aluminum-containing substrate having one or more plenums formed therein in an electroplating solution. The electroplating solution comprises a deposition precursor comprising $AlCl_3$, $Al(NO_3)_3$, or an aluminum alkyl and a non-aqueous solvent. The method further comprises depositing a coating on the aluminum-containing substrate, the coating comprising aluminum or aluminum oxide. Depositing the coating comprises applying a first current for a first time-period to nucleate a surface of the aluminum-containing substrate, wherein the first current is pulsed. Depositing the coating further comprises applying a second current for a second time-period to form the coating on the nucleated surface of the aluminum-containing substrate. The first current is greater than the second current and the first time-period is less than the second time-period.

In yet another implementation, a method of depositing a material on a substrate is provided. The method comprises positioning an aluminum-containing substrate having one or more plenums formed therein in an electroplating solution. The electroplating solution comprises a deposition precursor comprising $AlCl_3$, $Al(NO_3)_3$, or an aluminum alkyl, a non-aqueous solvent, and a supporting electrolyte. The method further comprises depositing a coating on the aluminum-containing substrate, the coating comprising aluminum or aluminum oxide. Depositing the coating comprises applying a first current for a first time-period to nucleate a surface of the aluminum-containing substrate, wherein the first current is pulsed. Depositing the coating further comprises applying a second current for a second time-period to form the coating on the nucleated surface of the aluminum-containing substrate. The first current is greater than the second current and the first time-period is less than the second time-period.

BRIEF DESCRIPTION OF THE DRAWINGS

So that the manner in which the above-recited features of the present disclosure can be understood in detail, a more particular description of the implementations, briefly summarized above, may be had by reference to implementations, some of which are illustrated in the appended drawings. It is to be noted, however, that the appended drawings illustrate only typical implementations of this disclosure and are therefore not to be considered limiting of its scope, for the disclosure may admit to other equally effective implementations.

Figure 1:
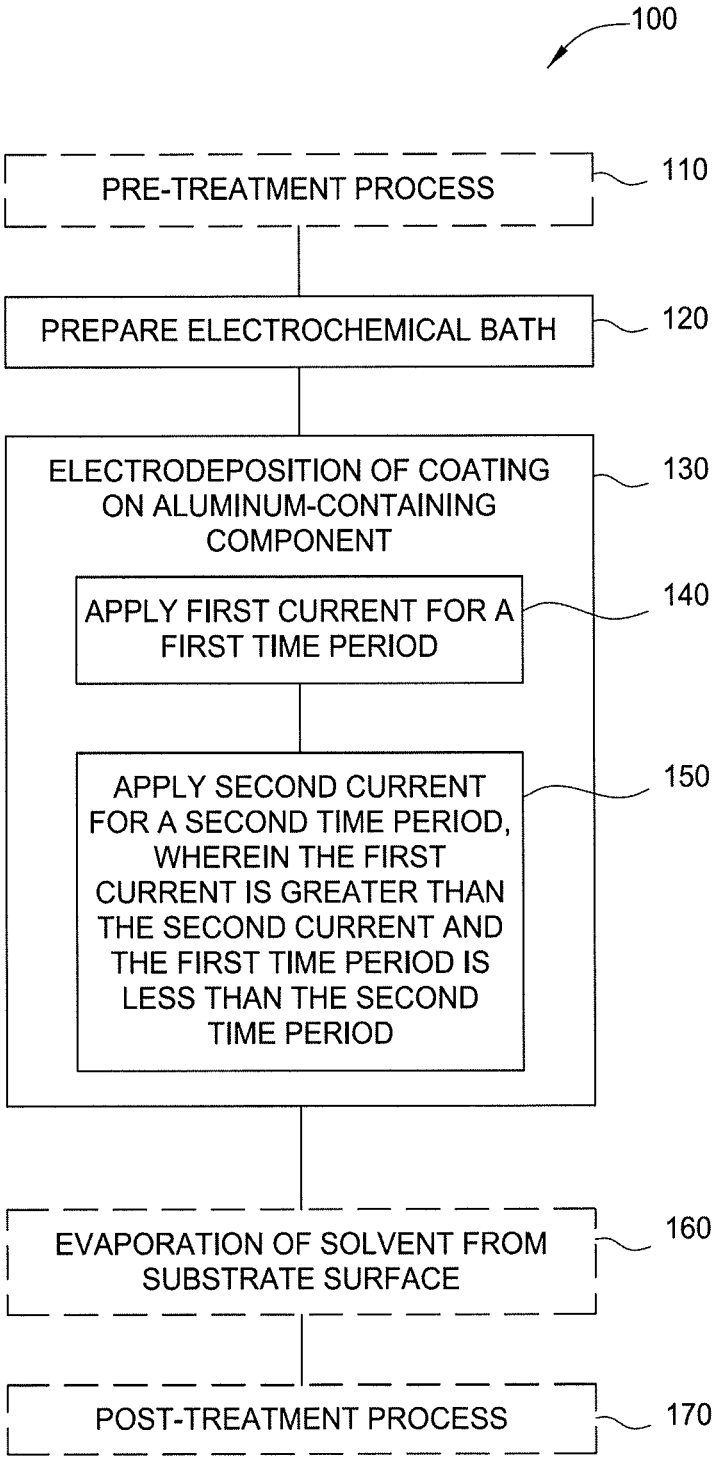
FIG. 1 illustrates a flow diagram of a method for electrodeposition of aluminum or aluminum oxide on a substrate in accordance with one or more implementations of the present disclosure.

To facilitate understanding, identical reference numerals have been used, where possible, to designate identical elements that are common to the figures. It is contemplated that elements and features of one implementation may be beneficially incorporated in other implementations without further recitation.

DETAILED DESCRIPTION

The following disclosure describes materials and coatings for aluminum and aluminum-containing components. Certain details are set forth in the following description and in FIGS. 1-3B to provide a thorough understanding of various implementations of the disclosure. Other details describing well-known structures and systems often associated with electroplating and electrodeposition are not set forth in the following disclosure to avoid unnecessarily obscuring the description of the various implementations.

Many of the details, dimensions, angles and other features shown in the Figures are merely illustrative of particular implementations. Accordingly, other implementations can have other details, components, dimensions, angles and features without departing from the spirit or scope of the present disclosure. In addition, further implementations of the disclosure can be practiced without several of the details described below.

Implementations described herein will be described below in reference to a semiconductor processing system. However, other tools containing aluminum components may also be adapted to benefit from the implementations described herein. The apparatus description described herein is illustrative and should not be construed or interpreted as limiting the scope of the implementations described herein.

Previously it was not possible to achieve smooth uniform crack-free coating of aluminum. Some implementations of the present disclosure will lead to smooth uniform crack free of coating of aluminum by controlling process parameters during the two-stage plating process. Implementations of the present disclosure provide a two-stage electrodeposition process, which includes instantaneous nucleation of an aluminum-containing surface followed by stress free growth of an aluminum-containing layer on the nucleated surface. The first stage of the nucleation process includes nucleation of the aluminum surface and the second stage involves slow growth of the nucleated aluminum. The nucleation process is achieved by passing higher current for a shorter duration to create multiple nuclei and the slow growth process is achieved by passing a lower current for a longer duration so the nucleated aluminum grows in a controlled manner. In some implementations of the present disclosure, the aluminum-containing layer can be deposited from acetonitrile and ethanol solution at less than 4 Volts. Deposition of the aluminum-containing layer by passing lower current and hence lower potential will substantially improve the plating bath life.

Figure 2:
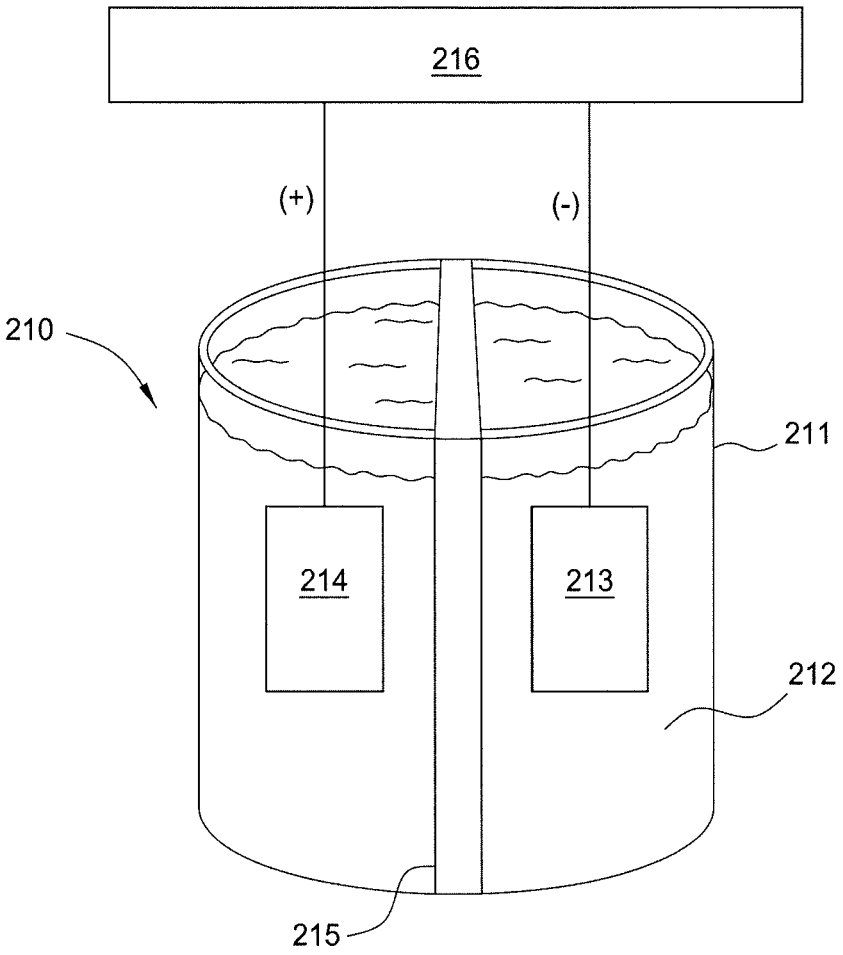
FIG. 2 illustrates an electrochemical bath in accordance with one or more implementations of the present disclosure.

FIG. 1 illustrates a flow diagram of a method 100 for electrodeposition of an aluminum-containing layer on a substrate in accordance with one or more implementations of the present disclosure. The aluminum-containing layer is generally aluminum oxide (e.g., $Al_xO_y$), and often approximately $Al_2O_3$, but variations in the alumina stoichiometry are contemplated and are considered within the scope of this disclosure. The substrate is generally an aluminum-containing component. FIG. 2 illustrates an electrochemical bath in accordance with one or more implementations of the present disclosure. FIGS. 1 and 2 will be explained in conjunction to facilitate explanation of aspects of the disclosure.

In one implementation, the aluminum-containing component is composed of an aluminum alloy. In one implementation, the aluminum alloy includes magnesium as its major alloying element. One exemplary aluminum alloy that may benefit from the teachings of the present disclosure is Al6061 aluminum alloy (aluminum (95.85-98.56% by weight), silicon (0.4-0.8% by weight), iron (0-0.7% by weight), copper (0.15-0.4% by weight), manganese (0-0.15% by weight), magnesium (0.8-1.2% by weight), chromium (0.04-0.35% by weight), zinc (0-0.25% by weight), and titanium (0-0.15% by weight)). Another exemplary aluminum alloy that may benefit from the teachings of the present disclosure is Al6063 aluminum alloy (aluminum (95.85-98.56% by weight), silicon (0.2-0.6% by weight), iron (0-0.35% by weight), copper (0-0.10% by weight), manganese (0-0.10% by weight), magnesium (0.45-0.9% by weight), chromium (0-0.10% by weight), zinc (0-0.10% by weight), and titanium (0-0.10% by weight)). Other aluminum alloys may also benefit from the teaching of the present disclosure. The aluminum-containing component may have a natural oxide layer formed on at least one surface of the component. Method 100 is used, for example on an aluminum-containing component that is new or has been treated to remove previous coatings. Certain portions of method 100 may be performed differently than those shown in exemplary method 100, as described further below.

In one implementation, the aluminum-containing component is semiconductor-processing equipment. Examples of semiconductor processing equipment include components formed from aluminum or aluminum alloys, such as showerheads or gas distributors, or other equipment, which may have a plurality of gas passages formed therein. It is contemplated that aluminum-containing components without gas passages formed therein may also be subjected to method 100.

The method 100 begins optionally at operation 110. In operation 110, an aluminum-containing component is exposed to an optional pre-treatment process. The aluminum-containing component may be substrate 214. The optional pre-treatment process may include exposing the substrate 214 to an acid, base or solvent to clean the surface of the substrate 214 in preparation for electroplating material on the surface of the substrate 214. Exemplary acids, bases, or solvents include $HF/HNO_3$, HCl, $HNO_3$ and isopropyl alcohol.

Any suitable wet-clean process for removing residue from the aluminum-containing component may be used. In one implementation, an $HNO_3$:HF wet-clean process is used. In one implementation, the wet-clean solution comprises an aqueous solution of hydrofluoric and nitric acids. The hydrofluoric acid may for example, be present in a concentration of 1% by weight, based on the total weight of the solution, and the nitric acid may for example be present in a concentration of 7% by weight, on the same total weight basis. The amount of HF may in general vary from about 0.2% to about 5% by weight, based on the total weight of the solution, and the nitric acid may in general vary from about 5% to about 20% by weight, on the same total weight basis. In one implementation, the weight ratio of $HNO_3$:HF in the wet-clean solution is in a range of from 1 to about 100, for example, from about 5 to about 20.

The conditions of the wet-clean solution contacting with the aluminum-containing surface may be widely varied in the general practice of the present disclosure. For example, the temperature of the wet-clean solution in such contacting stage, in one implementation, is in a range of between about 25 degrees Celsius to about 80 degrees Celsius (e.g., between about 30 degree Celsius to about 75 degrees Celsius; or between about 35 degrees Celsius to about 65 degrees Celsius). The contacting time in the wet-clean solution may be varied with the temperature for a given wet-clean application being inversely related to the contacting time involved, as well as being functionally related to the type and concentration of the acids in the wet-clean solution, and the nature and extent of the contamination of the aluminum-containing surface to be cleaned.

Numerous substitutions and rearrangements of operation 110 will be apparent to one skilled in the art, and all such substitutions and rearrangements are considered to be within the scope of the present disclosure. A few examples of such substitutions and rearrangements are to include a DI water flush and clean dry air ("CDA") drying stages; to perform any of the CDA drying stages with nitrogen ($N_2$) or other relatively inert gas instead of CDA; to utilize heated CDA (or other relatively inert gas) to promote drying; and/or to shorten or lengthen the DI water flush or CDA drying stages.

In operation 120, an electrochemical bath 210 is prepared. The electrochemical bath 210 includes a container 211 having an electroplating solution 212 disposed therein. The electroplating solution 212 may include one or more of a solvent, a supporting electrolyte, one or more deposition precursors, and electroplating additives. The electroplating solution 212 may be conductive to facilitate electrochemical deposition. An anode 213 and the substrate 214, which functions as a cathode, are positioned in the electroplating solution 212 and may be separated by a divider 215, such as a porous membrane. For example, the divider 215 may be a perforated PVDF sheet, which reduces the likelihood of physical contact between the anode 213 and the substrate 214. The anode 213 and the substrate 214 are coupled to a power supply 216, such as a DC power supply to facilitate electroplating of material onto the substrate 214. In one example, the anode 213 is formed from aluminum, such as Al6061 aluminum alloy. In one implementation, the DC power supply may supply a constant current or a constant voltage. In another implementation, the DC power supply supplies a pulsed current and/or voltage.

The electroplating solution 212 may include one or more solvents. The one or more solvents are selected from aqueous solvents, non-aqueous solvents, or combinations thereof. Exemplary aqueous solvents the may be used in electroplating solution 212 include water or solvents mixed water. Exemplary non-aqueous solvents that may be used in electroplating solution 212 include solvents such as dry acetonitrile, ethanol, toluene, propanol, isopropyl alcohol, N,N-Dimethylformamide ("DMF"), dichloromethane, dimethyl sulfoxide, propylene carbonate, or combinations thereof. Optionally, the electroplating solution 212 may be a mixture of two solvents in a ratio of between 4:1 and 1:4 (e.g., between 1:2 and 1:4; or between 1:3 and 1:4). Exemplary solvent mixtures that may be used in electroplating solution 212 include mixtures of acetonitrile and ethanol or mixtures of acetonitrile and DMF. In one implementation, the solvent is a mixture of acetonitrile and ethanol at a ratio of between 4:1 and 1:4.

The electroplating solution 212 may further include one or more supporting electrolytes to improve the conductivity of the electroplating solution 212. Exemplary supporting electrolytes that may be used with electroplating solution 212 include tetrabutylammonium perchlorate ($(CH_3CH_2CH_2CH_2)_4N(ClO_4)$), tetrabutyl-ammonium tetrafluoroborate ($(CH_3CH_2CH_2CH_2)_4N(BF_4)$), tetrabutylammonium hexafluorophosphate ($(CH_3CH_2CH_2CH_2)_4N(PF_6)$), tetraethylammonium perchlorate ($(CH_3CH_2)_4N(ClO_4)$), tetraethylammonium tetrafluoroborate ($(CH_3CH_2)_4N(BF_4)$), or combinations thereof. In one implementation, the supporting electrolyte is tetrabutylammonium hexafluorophosphate. The supporting electrolyte may be dissolved in the electroplating solution 212 at a concentration of between about 0.001 Molar (M) to about 2 M (e.g., between about 0.1 M to about 1 M; or between about 0.1 M to about 0.3 M).

The electroplating solution 212 may further include one or more aluminum-containing deposition precursors for supplying aluminum ions during the electroplating process. Exemplary aluminum-containing deposition precursors that may be used with electroplating solution 212 include $AlCl_3$, $Al(NO_3)_3$, aluminum alkoxide, or aluminum alkyl that may be dissolved in the electroplating solution 212. The one or more deposition precursors may be dissolved in the electroplating solution 212 at a concentration of between about 0.001 to about 2 M (e.g., between about 0.1 M to about 1 M; or between about 0.3 M to about 1 M).

The electroplating solution 212 may further include one or more additives to improve the quality and conformality of the plated material. One or more additives, such as potassium nitrate ($KNO_3$), sodium fluoride, sodium acetate, or sulfonamide may be added to the electroplating solution 212 to improve characteristics of the plated material. For example, the additives may be selected to improve planarity of the deposited coating, adjust composition of deposited coating, or to reduce roughness or cracking of the deposited coating. Additives may also be selected to improve the conductivity of the electroplating solution 212, thus increasing the deposition rate of the plated material and improving deposition uniformity. The one or more additives may be present in the electroplating solution 212 at a concentration of between about 0.001 M to about 1 M (e.g., between about 0.1 M to about 0.5 M; or between about 0.1 M to about 0.3 M). The substrate 214 may be positioned in the electroplating solution 212 after preparation thereof.

In another example, the electroplating solution 212 may include an electrolyte having the formula $AlX_3$ where X is chloride, or $AlR_3$ wherein R is $NO_3$ or methyl, ethyl, isopropyl, butyl, isobutyl, or O-i-Pr where i-Pr is the isopropyl group ($CH(CH_3)_2$). The solvent may be one or more of water, ethanol, dimethyl sulfoxide, isopropanol, acetonitrile, toluene, tetrahydrofuran, or hexane. Optionally, sodium acetate or tetrabutylammonium hexafluorophosphate may be added.

At operation 130, a material coating, such as aluminum or aluminum oxide, is electrodeposited on the substrate 214. A positive bias is applied to the anode 213 by the power supply 216, while a negative bias is applied to the substrate 214 by the power supply 216. Bias of the anode 213 and the substrate 214 facilitates electroplating of chosen materials, such as aluminum oxide from the electroplating solution 212 onto the substrate 214. Operation 130 is a two-stage process including nucleation of the substrate surface at operation 140 followed by stress-free growth or "slow growth" on the surface of the substrate at operation 150.

At operation 140, the anode 213 and the substrate 214 may be biased with a first voltage in the range of between about −1 volt to about −10 volts (e.g., between about −1 volt to about −5 volts; between about −1 volt to about −4 volts; or between about −2.5 volts to about −4 volts). The anode 213 and the substrate 214 may be biased with a first current in the range of between about −200 milliamperes (mA) to about −10 mA (e.g., between about −150 mA to about −60 mA, or between about −100 mA to about −80 mA). The bias power applied during operation 140 may be maintained for a time-period of between about 60 seconds and about 300 seconds (e.g., between about 100 seconds and about 200 seconds; or between about 100 seconds and about 150 seconds).

In another implementation, at operation 140, the anode 213 and the substrate 214 may be biased with a first voltage in the range of between about 1 volt to about 10 volts (e.g., between about 1 volt to about 5 volts; between about 1 volt to about 4 volts; or between about 2.5 volts to about 4 volts). The anode 213 and the substrate 214 may be biased with a first current in the range of between about 10 milliamperes (mA) to about 200 mA (e.g., between about 50 mA to about 100 mA, or between about 70 mA to about 80 mA). The bias power applied during operation 140 may be maintained for a time-period of between about 60 seconds and about 300 seconds (e.g., between about 100 seconds and about 200 seconds; or between about 100 seconds and about 150 seconds).

Additionally or alternatively, the use of pulse deposition techniques, where the potential or current is altered rapidly between two different values, is contemplated. The rapid alternation results in a series of pulses of equal amplitude, duration, and polarity, separated by zero current. Each pulse consists of an ON time ($T_{ON}$) and OFF time ($T_{OFF}$). During $T_{OFF}$, ions migrate to the depleted areas in the bath. During $T_{ON}$, more evenly distributed ions are available for deposition onto the substrate 214. In one example, $T_{ON}$ may be about 0.001 seconds to 60 seconds, and $T_{OFF}$ time may be about 0.001 seconds to 60 seconds.

In some implementations, the bias power applied during operation 140 is pulsed. The bias power may be pulsed on/off during operation 140. The bias power applied during operation 140 may be pulsed-on for a time-period of between about 10 milliseconds and about 90 milliseconds (e.g., from between about 20 milliseconds and about 80 milliseconds; between about 30 milliseconds and about 70 milliseconds; or from between about 60 milliseconds and about 80 milliseconds). The bias power applied during operation 140 may be pulsed-off for a time-period of between about 5 milliseconds and about 60 milliseconds (e.g., from between about 10 milliseconds and about 50 milliseconds; from between about 10 milliseconds and about 20 milliseconds; or from between about 40 milliseconds and about 60 milliseconds). In one implementation, the bias applied during operation 140 is pulsed-on for a time-period of about 90 milliseconds and pulsed-off for a time-period of about 10 milliseconds. In another implementation, the bias applied during operation 140 is pulsed-on for a time-period of about 70 milliseconds and pulsed-off for a time-period of about 10 milliseconds. In yet another implementation, the bias applied during operation 140 is pulsed-on for a time-period of about 30 milliseconds and pulsed-off for a time-period of about 50 milliseconds. In yet another implementation, the bias applied during operation 140 is pulsed-on for a time-period of about 40 milliseconds and pulsed-off for a time-period of about 40 milliseconds. In some implementations, the frequency during pulsing varies from about 8 Hz to about 14 Hz.

At operation 150, the anode 213 and the substrate 214 may be biased with a second voltage in the range of between about −1 volt to about −10 volts (e.g., between about −1 volt to about −5 volts; between about −1 volt to about −4 volts; or between about −2 volts to about −4 volts). The anode 213 and the substrate 214 may be biased with a second current in the range of between about −100 milliampere (mA) to about −1 mA (e.g., between about −50 mA to about −10 mA, or between about −50 mA to about −30 mA). The bias power applied during operation 150 may be maintained for a time-period of between about 20 minutes and about 5 hours (e.g., between about 1 hour and about 3 hours; or between about 1 hour and about 2 hours).

In another implementation at operation 150, the anode 213 and the substrate 214 may be biased with a second voltage in the range of between about 1 volt to about 10 volts (e.g., between about 1 volt to about 5 volts; between about 1 volt to about 4 volts; or between about 2.2 volts to about 4 volts). The anode 213 and the substrate 214 may be biased with a second current in the range of between about 1 milliampere (mA) to about 100 mA (e.g., between about 10 mA to about 50 mA; or between about 30 mA to about 50 mA). The bias power applied during operation 150 may be maintained for a time-period of between about 20 minutes and about 5 hours (e.g., between about 1 hour and about 3 hours; or between about 1 hour and about 2 hours).

In some implementations, the bias power applied during operation 150 is pulsed. The bias power may be pulsed on/off during operation 150. The bias power applied during operation 150 may be pulsed-on for a time-period of between about 10 milliseconds and about 90 milliseconds (e.g., from between about 20 milliseconds and about 80 milliseconds; between about 30 milliseconds and about 70 milliseconds; or from between about 60 milliseconds and about 80 milliseconds). The bias power applied during operation 150 may be pulsed-off for a time-period of between about 5 milliseconds and about 60 milliseconds (e.g., from between about 10 milliseconds and about 50 milliseconds; from between about 10 milliseconds and about 20 milliseconds; or from between about 40 milliseconds and about 60 milliseconds). In one implementation, the bias applied during operation 150 is pulsed-on for a time-period of about 90 milliseconds and pulsed-off for a time-period of about 10 milliseconds. In another implementation, the bias applied during operation 150 is pulsed-on for a time-period of about 70 milliseconds and pulsed-off for a time-period of about 10 milliseconds. In yet another implementation, the bias applied during operation 150 is pulsed-on for a time-period of about 30 milliseconds and pulsed-off for a time-period of about 50 milliseconds. In yet another implementation, the bias applied during operation 150 is pulsed-on for a time-period of about 40 milliseconds and pulsed-off for a time-period of about 40 milliseconds. In some implementations, the frequency during pulsing varies from about 8 Hz to about 14 Hz.

In some implementations, the first current applied during operation 140 is greater than the second current applied during operation 150 and the first time-period of operation 140 is less than the second time-period of operation 150 to form the coating on the nucleated surface of the aluminum-containing substrate. Not to be bound by theory but it is believed that the nucleation process of operation 140, which is achieved by passing higher current for a shorter duration, creates multiple nuclei on the surface of the substrate and the slow growth process of operation 150, which is achieved by passing a lower current for a longer duration, allows for aluminum growth in a controlled manner.

During operation 130, the electroplating solution 212 may be maintained at a temperature within a range of about 0 degrees Celsius to about 100 degrees Celsius (e.g., between about 10 degrees Celsius to about 50 degrees Celsius; between about 20 degrees Celsius to about 25 degrees Celsius). In one example, operation 130 may occur in an inert environment.

In one electroplating example, the electrochemical deposition of aluminum on the substrate 214 proceeds as follows:

Cathode:

$$Al^{3+}+2H^{+}+3e^{-}\rightarrow Al+H_2$$

Anode:

$$4OH^{-}\rightarrow 2O^{-}+2H_2O+4e^{-}$$

Optionally, in operation 160, the substrate 214 is removed from the electroplating solution 212, and excess electroplating solution 212 is removed from the surface of the substrate 214. Excess electroplating solution 212 may be removed, for example, via evaporation or drying. One or more of a dryer, hear source, light source, or a fan may facilitate the removal of the excess electroplating solution 212 from the substrate 214. Optionally, operation 160 may be omitted. Additionally or alternatively, the substrate 214 may be cleaned or washed using IPA or ethanol after operation 160. After exposure to the IPA or ethanol, the substrate may be dried using compressed dried air (CDA). Operation 160 may be performed in an inert atmosphere, for example, in a container having argon or diatomic nitrogen therein.

Optionally, in operation 170, after removal of the excess electroplating solution 212, the substrate 214 may be subjected to a post-treatment process. In one implementation, the post-treatment process of operation 170 includes an annealing process. In such an example, the substrate 214 may be annealed at a temperature of about 400 degrees Celsius or more. The anneal temperature may be selected to facilitate removal of hydroxyl moieties from the surface of the substrate 214 during the post-treatment process. In another implementation, the post-treatment process may be an oxidizing process. In such an example, the substrate 214 may be exposed to an oxygen-containing environment to facilitate oxidation of the plated material on the substrate 214. For example, the substrate may be exposed to oxygen, ozone, ionized oxygen, or an oxygen-containing gas. The oxidation of the plated material may be facilitated with plasma or thermal processing. The oxidation of the plated material improves the stability of the plated material when the substrate is utilized in manufacturing operations. The annealing process of operation 170 may also increase adhesion of the plated material to the underlying substrate 214.

In one implementation, the post-treatment process of operation 170 includes exposing the substrate 214 to a second bath. In the second bath, the substrate 214 may be anodized using neutral electrolytes at about 10 volts to about 200 volts to form an oxide layer on an outer surface of the plated coating. In another implementation, the post-treatment process may include exposing the substrate to nitric acid to oxidize the upper surface of the deposited coating. The nitric acid bath may include about 20% to about 69% nitric acid, and may be at a temperature of about 0 degrees Celsius to about 25 degrees Celsius. It is contemplated that temperatures below room temperature increase the density of the anodized layer compared to a similar nitric acid anodization process which occurs at room temperature or greater. In one example, the oxidized portion of the plated coating may have a thickness of about 200 nanometers or less, such as about 100 nanometers or less, such as about 5 nanometers or less. In one example, from about 5 percent to about 40 percent (e.g., from about 10 percent to about 30 percent; from about 10 percent to about 20 percent) of the plated aluminum layer may be anodized.

It is contemplated that characteristics of operations 140 and 150 may be varied to achieve a chosen thickness or composition of the plated material. For example, it is contemplated that the concentration of the deposition precursor, the duration of the bias voltage, or the magnitude of the bias voltage may be increased in order to increase the deposition rate or the thickness of the plated material. In one example, the plated material, such as aluminum or aluminum oxide, may be deposited to a thickness of between about 3 nanometers to about 8 micrometers (e.g., between about 100 nanometers to about 2 micrometers; between about 10 nanometers to about 500 nanometers; between about 200 nanometers to about 400 nanometers; or between about 1 micrometer to about 5 micrometers).

Examples

The following non-limiting hypothetical examples are provided to further illustrate implementations described herein. However, the examples are not intended to be all-inclusive and are not intended to limit the scope of the implementations described herein.

In one example, a coating is deposited on an aluminum coupon (1"×1") (e.g., Al6061) according to method 100. In the example, the aluminum coupon is placed in a plating bath. The plating bath includes $Al(NO_3)_3$ at a concentration of 0.3 M to 1 M, tetrabutylammonium hexafluorophosphate at a concentration of 0.1 M to 0.3 M, and acetonitrile and ethanol at a ratio of from about 4:1 to 1:4. The bath is maintained at a temperature between about 20 degrees Celsius to about 25 degrees Celsius. A first current (e.g., −70 mA) is applied for a first time-period (e.g., 60 seconds to 300 seconds) to nucleate a surface of the aluminum-containing substrate. The first current is pulsed-on for about 70 milliseconds and pulsed-off for about 10 milliseconds during the first time-period. A second current (e.g., −30 mA) is applied for a first second time-period (e.g., 20 minutes to 5 hours) to deposit an aluminum-containing coating having a thickness of about 1 micrometer on the nucleated surface of the aluminum coupon.

Figure 3A:
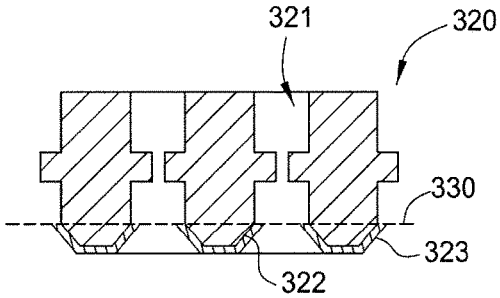
FIGS. 3A and 3B respectively illustrate partial sectional view of a showerhead and faceplate coated in accordance with one or more implementations of the present disclosure.
Figure 3B:
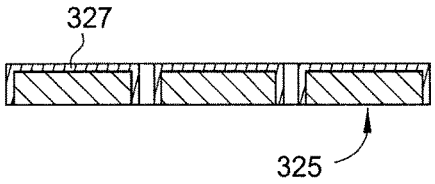

FIGS. 3A and 3B respectively illustrate partial sectional views of a showerhead 320 and a faceplate 325 coated using methods described herein. The electroplating methods described herein result in improved electroplating of mechanical components, particularly those including orifices, holes, plenums, and the like. Referring to FIG. 3A, the showerhead 320 includes improved coating coverage of bevels 322 of plenums 321 compared to conventional approaches. Using methods described herein, electroplating results in complete and uniform deposition of respective coatings 323, 327 over all surfaces submerged in an electroplating bath. The submerged portions of the showerhead 320 are indicated by the line 330. However, it is to be understood that the entire showerhead 320 may be submerged in the electroplating bath. In such an implementation, areas of undesired deposition may be masked to prevent electroplating.

In summary, some of the benefits of the present disclosure include the following. In some implementations, the two-stage electrodeposition process described herein deposits a uniform crack-free aluminum-containing layer of micrometer thickness. In some implementations, deposition of the aluminum-containing layer is achieved by passing lower current and hence lower potential through the electroplating bath, which substantially improves the stability of the electroplating bath leading to increased bath life. In some implementations, the aluminum-containing layer described herein increases component lifetime while reducing particle and contamination problems.

When introducing elements of the present disclosure or exemplary aspects or implementation(s) thereof, the articles "a," "an," "the" and "said" are intended to mean that there are one or more of the elements.

As used herein, the terms "comprising," "including" and "having" are intended to be inclusive and mean that there may be additional elements other than the listed elements.

As used herein, the term "between" is inclusive such that, for example, the range of between about 5 to about 40 weight percent includes about 5 percent and about 40 percent.

While the foregoing is directed to implementations of the present disclosure, other and further implementations of the present disclosure may be devised without departing from the basic scope thereof, and the scope thereof is determined by the claims that follow.

The invention claimed is:

1. A method of depositing a material on a substrate, comprising:

positioning an aluminum-containing substrate in an electroplating solution, the electroplating solution comprising a non-aqueous solvent and a deposition precursor;

depositing a coating on the aluminum-containing substrate, the coating comprising aluminum or aluminum oxide, wherein depositing the coating comprises:

applying a first current for a first time-period to nucleate a surface of the aluminum-containing substrate; and applying a second current for a second time-period, wherein the first current is greater than the second current and the first time-period is less than the second time-period to form the coating on the nucleated surface of the aluminum-containing substrate;

wherein the first current is between about −150 milliamperes (mA) and about −60 mA and the second current is between about −50 mA and about −30 mA; and wherein the first time-period is between about 60 seconds and about 300 seconds and the second time-period is between about 20 minutes and about 5 hours.

2. The method of claim 1, wherein the electroplating solution comprises the non-aqueous solvent and a second solvent in a ratio of between 4:1 and 1:4.

3. The method of claim 1, wherein the aluminum substrate comprises Al6061 or Al6063 alloy.

4. The method of claim 1, wherein the deposition precursor comprises $AlCl_3$ or $Al(NO_3)_3$.

5. The method of claim 4, wherein the deposition precursor has a concentration within a range of about 0.3 M to about 1 M.

6. The method of claim 1, wherein the electroplating solution further comprises a supporting electrolyte.

7. The method of claim 6, wherein the deposition precursor has a concentration within a range of about 0.1 M to about 0.3 M.

8. The method of claim 1, wherein depositing the coating comprises pulsing the first current on and off.

9. The method of claim 1, wherein the coating has a thickness of between about 100 nanometers to about 2 micrometers.

10. A method of depositing a material on a substrate, comprising:

positioning an aluminum-containing substrate having one or more plenums formed therein in an electroplating solution, the electroplating solution comprising:

a deposition precursor comprising $AlCl_3$, $Al(NO_3)_3$, or an aluminum alkyl; and a non-aqueous solvent; and depositing a coating on the aluminum-containing substrate, the coating comprising aluminum or aluminum oxide, wherein depositing the coating comprises:

applying a first current for a first time-period to nucleate a surface of the aluminum-containing substrate, wherein the first current is pulsed; and applying a second current for a second time-period, wherein the first current is greater than the second current and the first time-period is less than the second time-period to form the coating on the nucleated surface of the aluminum-containing substrate;

wherein the first time-period is between about 60 seconds and about 300 seconds and the second time-period is between about 20 minutes and about 5 hours; and wherein the first current is between about −150 milliamperes (mA) and about −60 mA and the second current is between about −50 mA and about −30 mA.

11. The method of claim 10, wherein the first current is pulsed-on for a third time-period of between about 30 milliseconds and about 70 milliseconds and the first current is pulsed-off for a fourth time-period of between about 10 milliseconds and about 20 milliseconds.

12. The method of claim 10, further comprising:

removing excess plating solution from the aluminum-containing substrate, wherein removing the excess plating solution comprises washing and drying the aluminum-containing substrate; and post-treating the aluminum-containing substrate having the coating thereon.

13. The method of claim 12, wherein the post-treating comprises exposing the aluminum-containing substrate to an ozone plasma.

14. A method of depositing a material on a substrate, comprising:

positioning an aluminum-containing substrate having one or more plenums formed therein in an electroplating solution, the electroplating solution comprising:

a deposition precursor comprising $AlCl_3$, $Al(NO_3)_3$, or an aluminum alkyl;

a non-aqueous solvent; and a supporting electrolyte;

depositing a coating on the aluminum-containing substrate, the coating comprising aluminum or aluminum oxide, wherein depositing the coating comprises:

applying a first current for a first time-period to nucleate a surface of the aluminum-containing substrate, wherein the first current is pulsed; and applying a second current for a second time-period, wherein the first current is greater than the second current and the first time-period is less than the second time-period to form the coating on the nucleated surface of the aluminum-containing substrate;

wherein the first time-period is between about 60 seconds and about 300 seconds and the second time-period is between about 20 minutes and about 5 hours; and wherein the first current is between about −150 milliamperes (mA) and about −60 mA and the second current is between about −50 mA and about −30 mA.

* * * * *